US005146624A

United States Patent [19]

Brückner

[11] Patent Number: 5,146,624

[45] Date of Patent: Sep. 15, 1992

[54] HAND PROTECTOR FOR PUGILISTIC SPORTS

[76] Inventor: George F. Brückner, Hohenzollerndamm 177, D-1000 Berlin 31, Fed. Rep. of Germany

[21] Appl. No.: 423,420

[22] PCT Filed: May 25, 1987

[86] PCT No.: PCT/DE87/00238

§ 371 Date: Sep. 29, 1989

§ 102(e) Date: Sep. 29, 1989

[87] PCT Pub. No.: WO88/07395

PCT Pub. Date: Oct. 6, 1988

[30] Foreign Application Priority Data

Apr. 1, 1987 [DE] Fed. Rep. of Germany ..... 3710832

[51] Int. Cl.[5] ..... A41D 13/10

[52] U.S. Cl. ..... 2/18; 2/16

[58] Field of Search ..... 2/18, 161 A, 16, 161 R, 2/167, 169

[56] References Cited

U.S. PATENT DOCUMENTS

| | | | |
|---|---|---|---|
| 1,453,715 | 5/1923 | Levinson | 2/18 |
| 1,534,654 | 4/1925 | Netz et al. | 2/18 |
| 1,752,977 | 4/1930 | Dieterle | 2/18 |
| 3,903,546 | 9/1975 | Rhee | 2/18 X |
| 4,287,610 | 9/1981 | Rhee | 2/18 |
| 4,361,912 | 12/1982 | Arthur | 2/18 |
| 4,603,439 | 8/1986 | Golomb | 2/18 |

FOREIGN PATENT DOCUMENTS

| | | | |
|---|---|---|---|
| 155053 | 8/1951 | Australia | 2/18 |
| 719956 | 12/1954 | United Kingdom | 2/18 |
| 2088729 | 6/1982 | United Kingdom | 2/18 |

*Primary Examiner*—Werner H. Schroeder
*Assistant Examiner*—Sara M. Current
*Attorney, Agent, or Firm*—Herbert L. Lerner; Laurence A. Greenberg

[57] ABSTRACT

A hand protection for combative types of sport has a flexible sheath of leather or imitation leather and an inset, elastic foam padding. In order to achieve optimum cushioning and shock absorption, the padding is made of a mould (1) formed in a single piece of highly shock-absorbing, open cellular polyurethane foam and having a region (2) covering the wrist, the back of the hand and the fingers that is curved in the transverse direction so as to match the natural curve of the hand and curved downwards in the longitudinal direction by approximately 90° in the area of the lower knuckles, having a reinforcement in that area. Furthermore, a flat thumb part (4) can be laterally formed on the same level as the hand part (2) to cover as an arch the upper side of the thumb in the hand protection sheath.

14 Claims, 5 Drawing Sheets

HAND PROTECTOR FOR PUGILISTIC SPORTS

The invention relates to a hand protector for use in pugilistic sports, having a flexible cover of leather or imitation leather and inserted therein a one-piece, elastic padding of foam.

A boxing glove designed according to these principles is known from German published non-prosecuted application DE-OS 31 47 997. There, a pre-formed flat body of a closed pore foam material is inserted into a corresponding cover, which does not have a separate section for the thumb, to reduce the danger of injury in boxing.

The closed pore foam material used, although highly elastic, shows almost no damping effect or absorption of blows, it only resiliently returns or conducts the applied force practically unmodified.

In addition, this boxing glove is relatively impractical, since, although it provides basic protection for the thumb by enclosing the thumb in the main glove opening and avoids particularly the bending-out of the thumb during the fight, this has proven to be not very useful for the freedom of movement of the hand.

Conventional boxing gloves do provide an elastically resilient filling; this filling, however, consists of fibers and/or plastic foam which offer only limited absorption of blows on the one hand, and on the other hand they are compressed within the cover and may be displaced, especially at the hitting areas, so that after some use the blow padding is no longer ascertained.

It is therefore an object of the present invention to provide a hand protector for use in pugilistic sports such as, for example, boxing, kick boxing, Thai boxing and other all-contact types of fighting sports, which, although basically similar to a boxing glove on the outside, assures optimal reduction of impact forces, so that whiplash accellerations to the brain are considerably reduced. Additionally, this hand protector is intended to be very resistant to fatigue, so that there is no fear of a change in the consistency and/or distribution of the filler.

To attain this object it is provided by the invention to make the padding from a one-piece shaped body of highly cushioning, open pore polyurethane foam material, which is arched crosswise, corresponding to the natural arch of the hand, on the outside and inside over its entire length, and in the longitudinal direction is arched downwardly at an angle of approximately 90 in the region of the rear knuckles and is reinforced in this region. A flat thumb may thereby be connected laterally in the region of the palm of the hand, the thumb region archingly covering the upper surface of the thumb within the hand protector cover.

A highly cushioning effect is realized with such an insert of open pore foam material, i.e the impact forces are reduced to a high degree and are dissipated, thus simultaneously reducing the whiplash effects, which have a particularly negative effect on the brain. Additionally, the provided shape of the foam body, after insertion into the cover of the glove, results in a form which approximates the position of a curved hand made into a fist, so that only small additional force is required to close the hand completely.

It has proven particularly useful when in the region of the bulge of the plastic foam shaped body the radius of curvature of the outer surface is no larger than the radius of curvature of the inner surface and that the outer and inner surfaces approach each other approximately asymptotically towards the finger tips on the one end and towards the wrist at the other end. This creates reinforcement in the main area of the hand protector without necessitating discontinuous material transition regions.

It is furthermore useful to provide a cup-shaped arch on the foam body laterally in the region of the index finger opposite the tip of the thumb which covers the thumb when the fist is made. By means of this, blows, which impact the thumb from the front and which might cause sprains, are safely prevented.

In order to also allow closing of the fist practically without exertion of force it is useful to provide the foam body on its underside in the region of the rear knuckles with an indentation, nearly wedge-shaped in cross section, extending crosswise over the body.

The region of the shaped body covering the wrist can be formed on the shaped body forming the back of the hand and the thumb via a flange of small thickness. However, it is also possible to provide the piece covering the wrist as a separate shaped body completely surrounding it.

The cover of the hand protector usefully comprises a blank covering the upper and lateral surfaces of the shaped body, a blank covering the inside of the hand and thumb and a blank covering the wrist on the inside and outside, made of leather or imitation leather, which are connected with each other, a fabric interlayer being worked in between the blank for the upper surface of the hand and thumb and the blank for the lower surface of the hand and thumb, which forms a separate chamber to receive the shaped foam body.

The wrist region may be separated by a wedge-shaped cut at the underside to ease putting on the hand protector.

It is useful for improving the fit if an inwardly projecting strip is provided as a grip in the top of the hand protector in the region of the fingertips. This strip may be in the form of a rand worked into the fabric interlayer in the transition region between the inner and outer blank of the cover.

To prevent the introduction of sweat from the wearer into the foam material, the shaped foam body may have a leather or imitation leather layer on the inside in the region of the back of the hand.

To make possible easier insertion of the shaped foam body into the hand protector it is useful to surround the shaped foam body with a thin sliding foil, in particular made of polyethylene, prior to insertion into the cover, which materially reduces possible friction.

For additional optimization of a hand protector, it is provided by the invention to form the closure of the hand protector in the region of the wrist solely by means of a Velcro band completely encircling the wrist. This makes possible quick and simple closing of the hand protector as well as adaptation to varying thicknesses of the arm and wrist. Furthermore, a chance of injury is removed which was very often caused by the customary lacing which required covering with an adhesive strip.

Design and function of exemplary embodiments of the invention are described in detail by means of schematic drawings.

Figure 3:
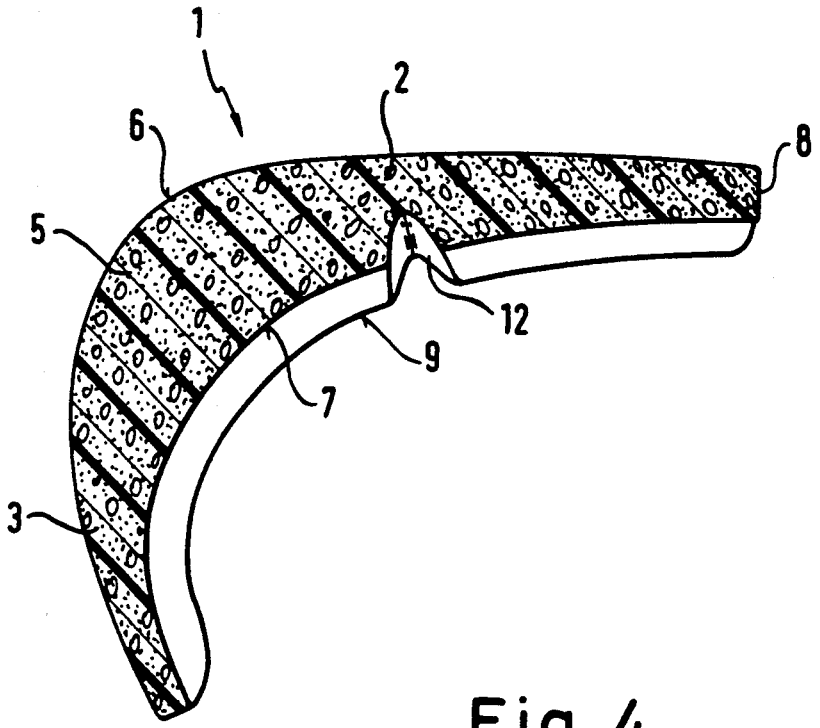
Figure 4:
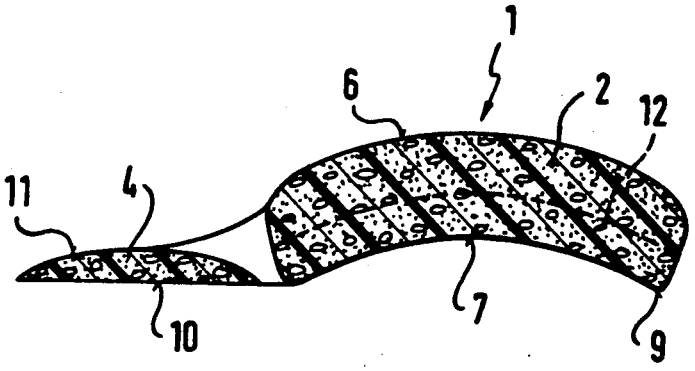
Figure 5:
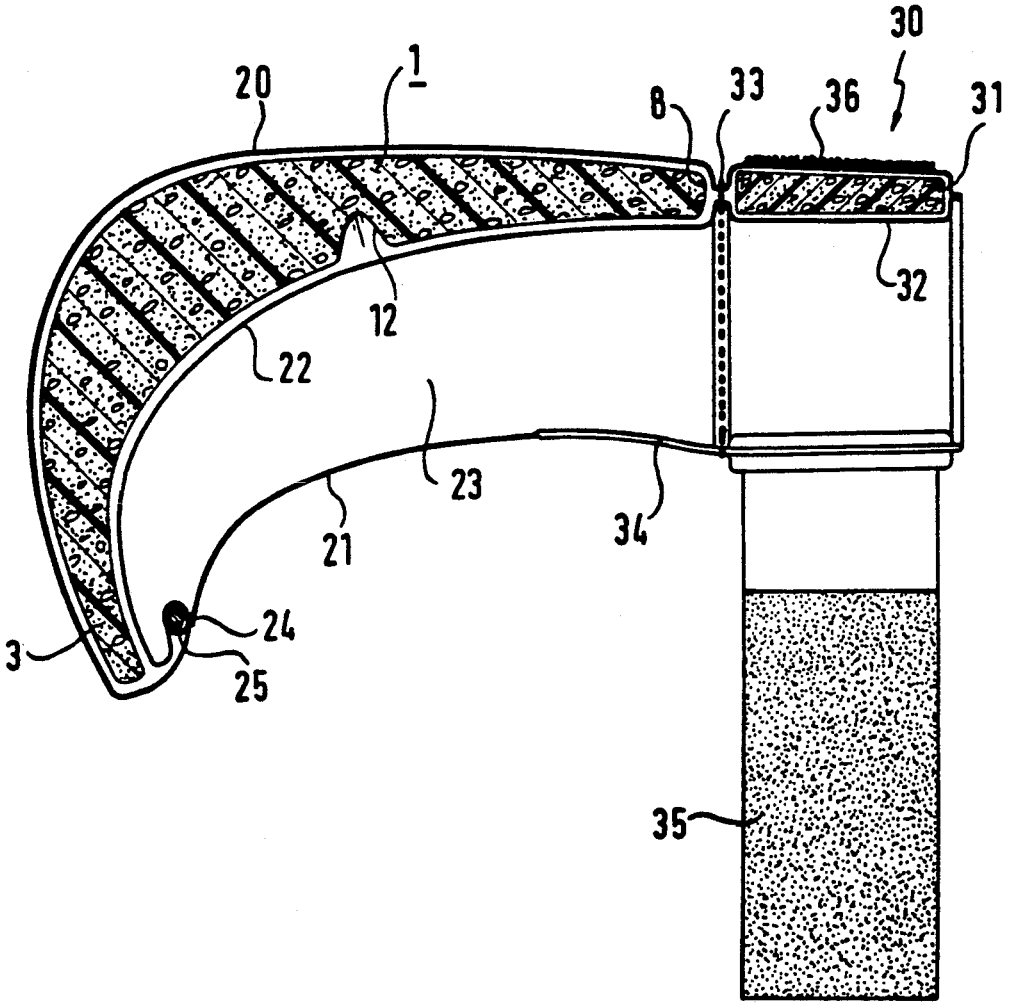
Figure 6:
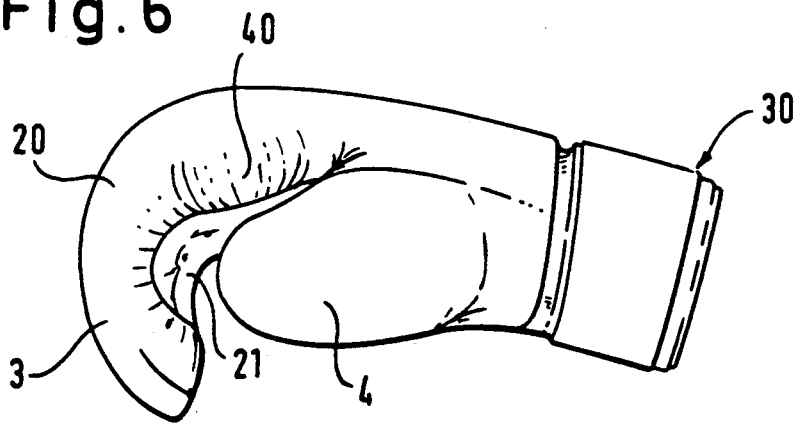
Figure 7:
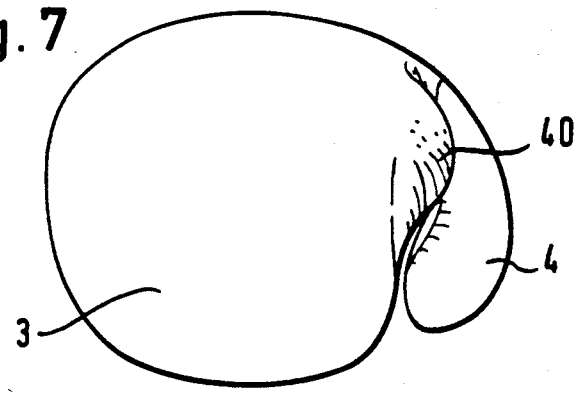
Figure 8:
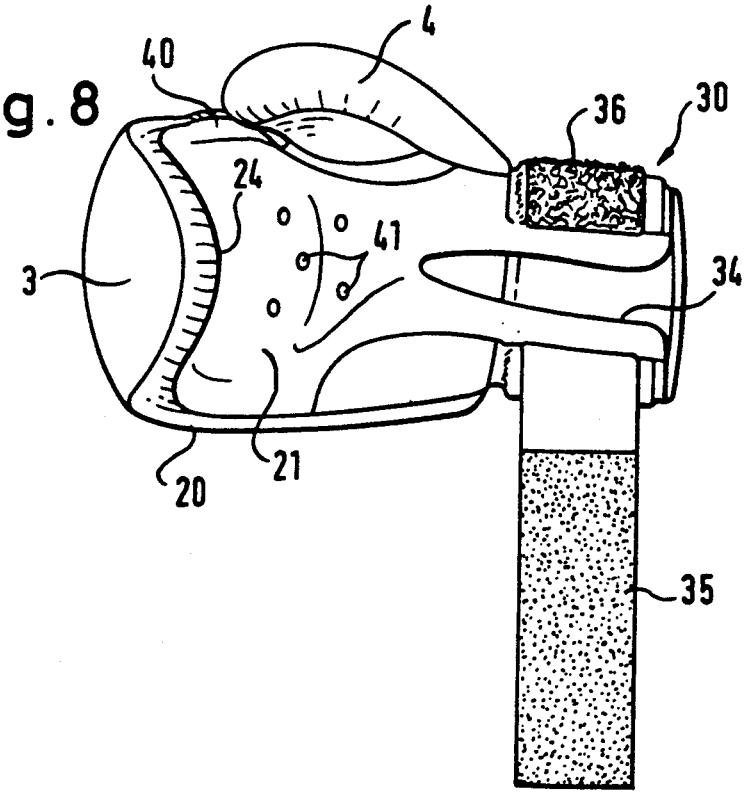
Figure 9:
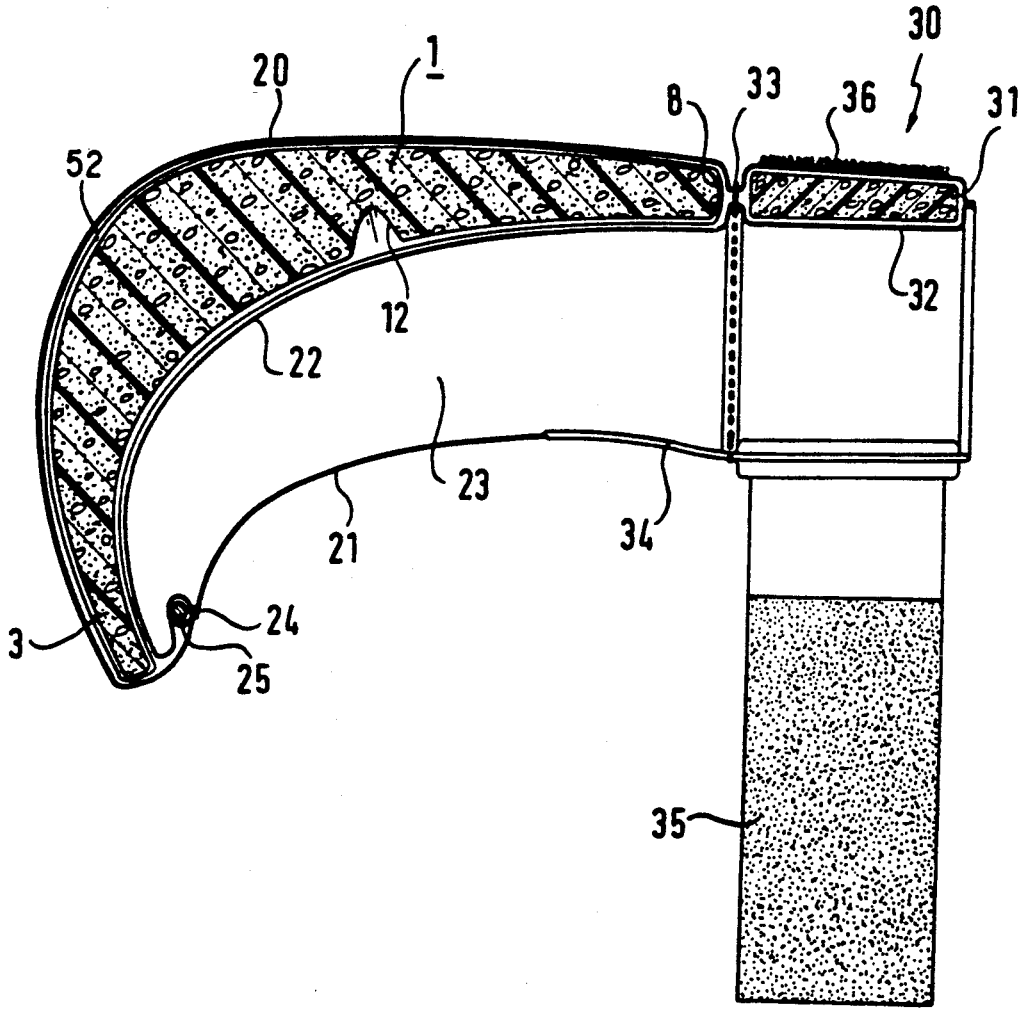

FIG. 3 is a section along the line III—III of FIG. 1 through the hand and finger region of the shaped body, FIG. 4 is a section along the line IV—IV of FIG. 1 through the hand and thumb region of the shaped foam body, FIG. 5 is a section through a finished hand protector, FIG. 6 is a lateral view towards the side of the thumb of the hand protector, FIG. 7 is a front view of the hand protector with thumb drawn in, FIG. 8 is a view from below of the hand protector with the Velcro band open, and FIG. 9 is a section through a finished hand protector according to a further embodiment.

Figure 1:
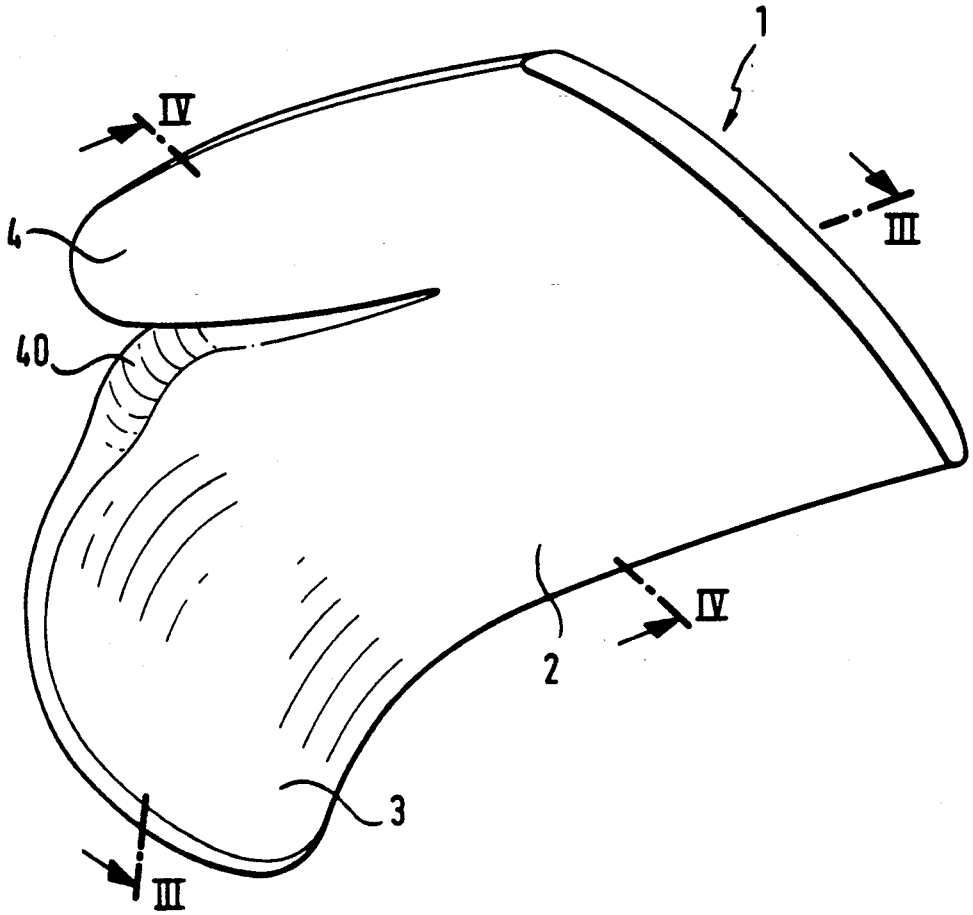
FIG. 1 is a perspective view of the shaped foam body obliquely from below.
Figure 2:
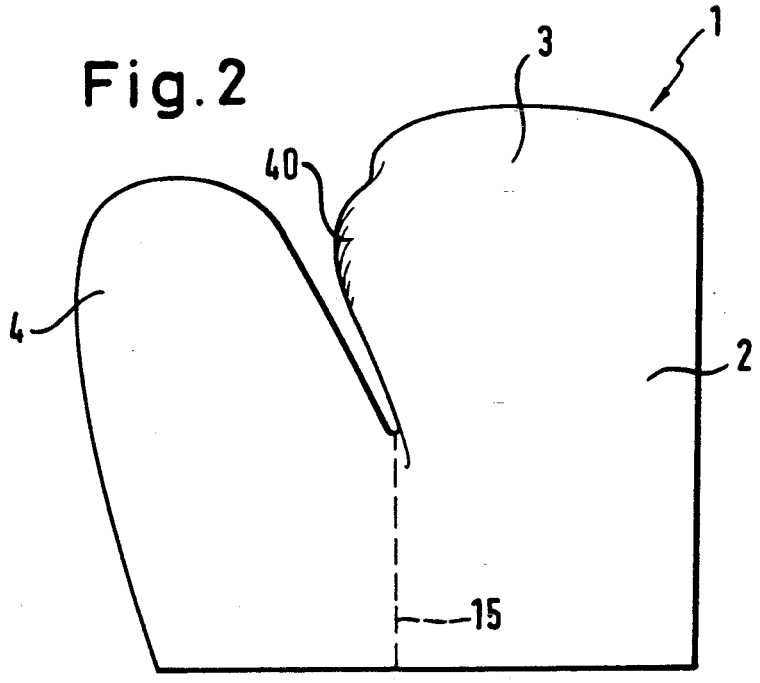
FIG. 2 is a view directly from above of the shaped foam body.

As shown in particular in FIGS. 1 and 2, the one-piece shaped body 1 of open pore foam material has a hand region 2 for covering the back of the hand and the fingers and, if desired, also of the wrist, and is arched downwardly at an angle of approximately 90° in the finger region. A flat thumb region 4 is laterally formed in one piece on the hand region 2 and extends approximately at an angle of 20° to the lateral axis of the hand region 2. However, in special cases of use it is also possible to omit this formed thumb region 4, as indicated by a dashed line, as will be described later.

The extent of the finger region 3, angled off from the region 2 of the back of the hand, is clearly visible from the longitudinal section according to FIG. 3, corresponding to the section line III—III of FIG. 1, the shaped body 1 showing a considerable bulge 5 in the transition zone. In order to obtain this bulge 5, which is constantly thickening, out of the remainder of the shaped body region, the radius of curvature of the outer surface 6 is smaller than that of the inner surface 7, as shown in the drawing, the outer and inner surfaces in their further extent drawing asymptotically closer in the region of the finger tips 3 and towards the neck of the wrist 8.

The result of this described arching of the shaped body and the correspondingly disposed thickening is that the part of the hand, namely the region of the back finger joints with which, when a fist is made, the punch is directly delivered and which must absorb the force of the punch, is the most heavily protected and takes up a nearly vertical position because of its shaping in order to achieve optimal effect.

To allow the closing of the fist practically without effort, an additional cut 12, almost wedge-shaped in cross section and extending crosswise over the shaped body 2, may be provided on the underside 7 of the shaped body 2 in the region of the rear knuckles.

The cross section of FIG. 4, corresponding to the sectional line IV—IV of FIG. 1, shows that the hand region 2 is also arched crosswise, corresponding to the natural arching of the hand, on its inner surface 7 in order to assure optimal fit. The edge 9, located further down because of the arching of the interior surface 7, is also visible in the cross section according to FIG. 3. The extent of the cut 12 is also indicated by dash-dotted lines.

Laterally to the hand region 2, a section through the thumb region 4, which has a flat underside 10 and an arched upper side 11, is shown. In relation to the width of the hand region 2, this thumb region 4 is relatively broad, as shown in particular by the top view according to FIG. 2, so that it archingly covers, drawn down laterally to a great degree, the upper surface of the thumb after introduction into the thumb cover.

In accordance with the longitudinal section through a finished hand protector, shown in FIG. 5, the shaped foam body 2 is enclosed on the upper surface by a blank 20, which extends around the side edges of the shaped body 2 and which meets on the inner side the blank 21, covering the inside of the hand, and is sewn together with it. These parts 20 and 21 are made of leather or of imitation leather. A fabric interlayer 22 is sewn between the two blanks 20 and 21, thus sectioning off from the actual hand space 23 a separate chamber for receiving the shaped foam body 2. In the area of the fingertips 3, a grip in the form of a rand 25 is worked into the fabric interlayer 22 in the region of the seam 24 between the upper blank 20 and the lower blank 21, which can be gripped from behind by the fingertips in order to provide better guidance for the lower point 3 of the hand protector and to pull it in to form a fist.

The actual wrist region 30 is separately attached at the back end 8 of the shaped body 1. It has an almost completely circumferential shaped foam body 31 enclosed by a cover 32, which is connected with the actual hand region via a seam 33. This wrist region 30 is divided on its underside by a wedge-shaped cut 34 for easing the insertion of the hand. The actual closure of the hand protector in the wrist region 30 is formed by a Velcro band 35 almost completely encircling the wrist, which is shown freely hanging down. The complementary surface 36 for the Velcro band 35 can be seen on the upper surface of the wrist region.

This closure of a hand protector, which may also be in a different form, solely by a Velcro band 35 for one allows a secure seating, even with the most diverse wrist thicknesses. Furthermore, the lacings customarily used up to now are no longer necessary. They could only be tightened to the correct degree with considerable effort and often were the cause of serious injury to the opponent.

FIG. 6 shows a lateral view of the entire hand protector in the direction of the thumb region 4. Here it can be seen that the thumb region 4 now is flipped vertically downwards and is protected in the front by the curved region 3. This view shows in particular that by means of the corresponding shape of the shaped foam body the finished hand protector already practically provides the natural position of the fist, so that additional tightening forces for making a fist are hardly required.

FIG. 7 is a front view of the hand protector, in which the thumb region 4 tightly adjoins the finger region 3. By means of an additionally provided lateral arching 40 at the side of the index finger, as can also be seen in FIGS. 1 and 2 at the shaped foam body 1, the thumb is also protected from above against direct blows and a uniform outer shape is the result, which provides assured protection for the thumb.

Finally, FIG. 8 shows a view from below of a hand protector with the Velcro band 35 opened. The vertically angled thumb region 4, the bent finger region 3 as well as the seam edge 24 between the upper blank 20 and the palm blank 21 are particularly clearly discernible. In addition, air vents 41 have been cut into the palm 21. The wrist region 30 is open by means of a wedge-shaped slit 34 extending as far as the palm surface 21 for easier insertion of the hand.

The shape of the shaped foam body of the hand protector for pugilistic sports described can also be slightly altered for various use and training purposes. For example, a hand protector used in sparring is provided with thicker padding and, if desired, without a separate thumb section.

FIG. 9 shows a cross-section of a further embodiment of the hand protector. The foam shaped body 1 is fully surrounded by a thin sliding foil 52, for instance formed of polyethylene. Friction is greatly reduced during the insertion into the cover 20 of the hand protector; this makes the finishing process a great deal easier.

Altogether, the result is an optimal hand protector which, because of shape and choice of material for its padding, considerably adds to protection from external and internal injuries. The impact forces are safely dissipated by the properties of the material and whiplash, which is of particular danger to the brain, is reduced.

I claim:

1. A hand protector for pugilistic sports, comprising a flexible cover of a material selected from the group consisting of leather and imitation leather, and an elastic padding of foam material inserted in said flexible cover, said padding being made from a one-piece shaped body of highly cushioning, open pore polyurethane foam material, and having a main section including a wrist section for covering the wrist, a hand section for covering the back of the hand and a finger section for covering the fingers, said main section being prearched crosswise, corresponding to the natural arch of the hand, and defining a downward arch in the longitudinal direction at an angle of substantially 90° in the vicinity of the rear knuckles and forming a bulge in the region of the downward arch, said elastic padding defining an outer surface with an outer radius of curvature and an inner surface with an inner radius of curvature, said outer radius of curvature in the vicinity of said bulge being at most equal to said inner radius of curvature, and said outer surface and said inner surface approaching each other substantially asymptotically towards a region for the fingertips on the one end and towards the wrist at the other end.

2. The hand protector according to claim 1, wherein said main section defines a given level, including a flat thumb section laterally formed on said main section at substantially said given level, said thumb section archingly covering the upper surface of the thumb inside said flexible cover.

3. The hand protector according to claim 2, including a layer of a material selected from the group consisting of leather and imitation leather disposed on said inner surface of said shaped foam body for covering the back of the hand.

4. The hand protector according to claim 2, wherein said main section has a region for the index finger and said thumb section has a forward tip, including a cup-shaped arch formed on said elastic padding laterally at said index finger region opposite said forward tip of said thumb section, said cup-shaped arch covering the thumb when a fist is made.

5. The hand protector according to claim 2, wherein said hand and thumb sections have a certain thickness and wherein said wrist section is formed on said hand section and said thumb section via a flange of relatively smaller thickness.

6. The hand protector according to claim 1, wherein said flexible padding has an underside and a given axis extending crosswise in the region of the rear knuckles, said padding including an indentation formed therein extending along said given axis and being substantially wedge-shaped as seen in a section perpendicular to said given axis.

7. The hand protector according to claim 1, wherein said flexible padding has lateral surfaces laterally adjacent said outer surface, said cover including an outer blank covering said outer surface and said lateral surfaces, an inner blank for covering the inside of the hand and thumb, and a wrist blank for covering the wrist formed of a material selected from the group consisting of leather and imitation leather, said blanks being connected with each other, and an intermediate layer of fabric for covering the upper surface of the hand and thumb disposed between said outer and inner blanks, said shaped foam body being disposed between said outer blank and said intermediate layer.

8. The hand protector according to claim 7, wherein the hand and arm define a longitudinal axis, said inner surface having a wedge-shaped cut formed therein extending substantially along said longitudinal axis and opening towards said wrist section.

9. The hand protector according to claim 7, including a hook-and-eye-type band attached to said wrist region for closing the hand protector in said wrist region, said band at least nearly encircling the wrist.

10. The hand protector according to claim 7, wherein the hand protector terminates in a protector cap in the region of the finger tips, and wherein an inwardly projecting ridge to serve as finger grip is formed in the vicinity of said protector cap.

11. The hand protector according to claim 10, wherein said ridge is in the form of a rand disposed in said fabric intermediate layer between said outer and inner blanks.

12. The hand protector according to claim 7, wherein said shaped foam body is covered with a thin sliding foil prior to insertion into said cover.

13. The hand protector according to claim 12, wherein said thin sliding foil is made of polyethylene.

14. A hand protector for pugilistic sports, comprising a flexible cover of a material selected from the group consisting of leather and imitation leather, and an elastic padding of foam material inserted in said flexible cover, said padding being made from a one-piece shaped body of highly cushioning, open pore polyurethane foam material, and having a main section including a hand section for covering the back of the hand and a finger section for covering the fingers, a wrist section made as a separate shaped body for completely surrounding the wrist, said main section being prearched crosswise, corresponding to the natural arch of the hand, and defining a downward arch in the longitudinal direction at an angle of substantially 90° in the vicinity of the rear knuckles and forming a bulge in the region of the downward arch, said elastic padding defining an outer surface with an outer radius of curvature and an inner surface with an inner radius of curvature, said outer radius of curvature in the vicinity of said bulge being at most equal to said inner radius of curvature, and said outer surface and said inner surface approaching each other substantially asymptotically towards a region for the fingertips on the one end and towards the wrist at the other end.

* * * * *